US010051950B2

(12) United States Patent
Nash et al.

(10) Patent No.: US 10,051,950 B2
(45) Date of Patent: Aug. 21, 2018

(54) DISCRETE HANDLES FOR CONTAINERS

(71) Applicant: H.B. Fuller Company, St. Paul, MN (US)

(72) Inventors: Jorge A. Nash, Vancouver, WA (US); Orion A. Cavins, Vancouver, WA (US); Dennis A. Bradshaw, Damascus, OR (US)

(73) Assignee: H.B. Fuller Company, St. Paul, MN (US)

( * ) Notice: Subject to any disclaimer, the term of this patent is extended or adjusted under 35 U.S.C. 154(b) by 0 days.

(21) Appl. No.: 15/197,163

(22) Filed: Jun. 29, 2016

(65) Prior Publication Data

US 2016/0376066 A1 Dec. 29, 2016

Related U.S. Application Data

(60) Provisional application No. 62/186,084, filed on Jun. 29, 2015.

(51) Int. Cl.
*A45F 5/10* (2006.01)

(52) U.S. Cl.
CPC .... *A45F 5/1026* (2013.01); *A45F 2005/1033* (2013.01)

(58) Field of Classification Search
CPC ..... B65D 26/2826; A45F 2005/104; A45F 2005/1053; A45F 2005/1033; A45F 5/1026
USPC ..... 220/769, 754; 16/114.1
See application file for complete search history.

(56) References Cited

U.S. PATENT DOCUMENTS

| | | | |
|---|---|---|---|
| 1,171,228 | A | 2/1916 | Misroch et al. |
| 2,639,082 | A | 5/1953 | Goldsmith |
| 2,722,870 | A | 11/1955 | Vogl |
| 2,981,455 | A | 4/1961 | Cope |
| 3,608,814 | A | 9/1971 | Lautin |
| 3,774,836 | A | 11/1973 | Nunn |
| 3,801,012 | A | 4/1974 | Thelen |
| 3,814,304 | A | 6/1974 | Hester |
| 4,286,714 | A | 9/1981 | Zdarsky et al. |
| 4,418,864 | A | 12/1983 | Nielsen |
| 4,498,620 | A | 2/1985 | Dickert et al. |
| 4,583,681 | A | 4/1986 | Neese |
| 4,816,014 | A | 3/1989 | Bratton et al. |
| 5,079,900 | A | 1/1992 | Pincky et al. |
| 5,080,281 | A | 1/1992 | Seabold |

(Continued)

FOREIGN PATENT DOCUMENTS

| | | |
|---|---|---|
| CN | 201376700 | 1/2010 |
| DE | 3440958 | 5/1986 |

(Continued)

*Primary Examiner* — Anthony Stashick
*Assistant Examiner* — Raven Collins
(74) *Attorney, Agent, or Firm* — Kirsten Stone; Daniel Barta

(57) ABSTRACT

Disclosed discrete handle articles comprise a load bearing element and a base element. The load bearing element of the discrete handle has a unity construction to distribute engagement forces along a broad area of the handle and the associated container and to prevent the handle from zippering the container. The base element of the discrete handle provides a support and can also provide sift proof surface to the load bearing element of the discrete handle.

6 Claims, 28 Drawing Sheets

(56) References Cited

U.S. PATENT DOCUMENTS

| | | | | | |
|---|---|---|---|---|---|
| 5,145,108 | A | | 9/1992 | Pincky et al. | |
| 5,320,279 | A | | 6/1994 | Giblin et al. | |
| 5,431,334 | A | | 7/1995 | Mattson | |
| 5,467,915 | A | * | 11/1995 | Mattson | A45C 13/26<br>215/396 |
| 5,639,017 | A | | 6/1997 | Fogle | |
| 7,441,693 | B2 | | 10/2008 | Liao | |
| 8,032,986 | B2 | * | 10/2011 | Lawrence | A45F 5/10<br>16/114.1 |
| D678,678 | S | * | 3/2013 | Santy | D3/318 |
| 2012/0104079 | A1 | | 5/2012 | Wagner | |

FOREIGN PATENT DOCUMENTS

| | | |
|---|---|---|
| EP | 1069054 | 1/2001 |
| FR | 2501635 | 9/1982 |

* cited by examiner

DISCRETE HANDLES FOR CONTAINERS

This application claims the benefit of U.S. Provisional Application No. 62/186,084 filed Jun. 29, 2015, which is incorporated herein.

FIELD

This disclosure is directed toward discrete handles for containers, such as for paperboard or corrugated paperboard containers.

BACKGROUND

FIG. 1 is an example of a handle commonly used in conjunction with paperboard or corrugated paperboard containers. The handle has a plastic strap which is glued between two or more layers of web. The strap is folded along an exposed portion of its length and glued in place along the webbed layer's upper surface. When engaged, the exposed portion of the strap becomes detached from the fabric surface and is free to be gripped.

FIG. 2 is another exemplary handle used in conjunction with a container such as paperboard or corrugated paperboard containers. This handle is a flexible handle of unity construction which has a substantially flat profile with a strap attached to flexible hinges and which can be secured flush with a surface of a container and then lifted up to use.

SUMMARY

Disclosed are discrete handles for containers that comprise at least two elements—a load bearing element and a base element. The load bearing element of the discrete handle has a unity construction to distribute engagement forces along a broad area of the handle and the associated container and to prevent the handle from zippering the container. The base element of the discrete handle provides a support and can also provide sift proof surface to the load bearing element of the discrete handle.

The foregoing and other objects, features, and advantages of the disclosed technology will become more apparent from the following detailed description, which proceeds with reference to the accompanying figures.

DETAILED DESCRIPTION

Figure 1:
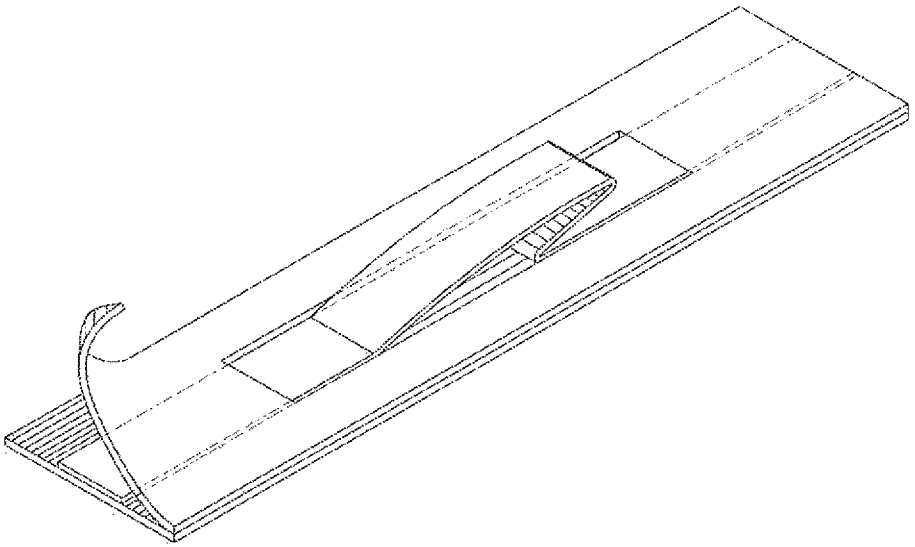
FIG. 1 PRIOR ART
FIG. 1 is a perspective view of a first prior art handle for containers.
Figure 2:
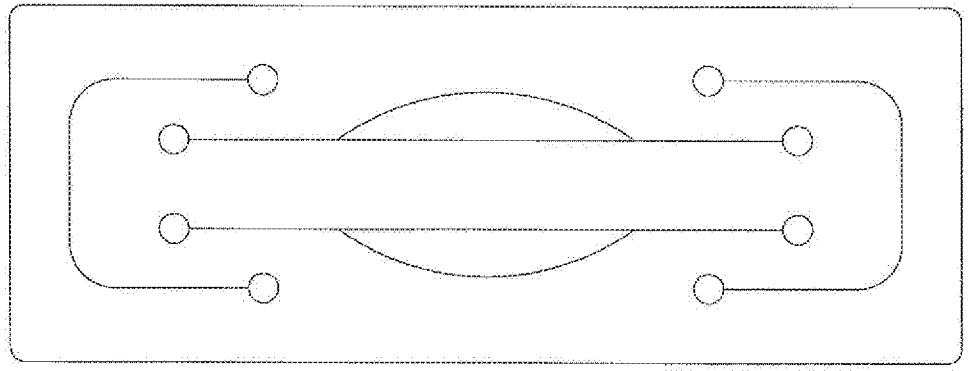
FIG. 2 PRIOR ART
FIG. 2 is an elevation view a second prior art handle for containers.
Figure 3:
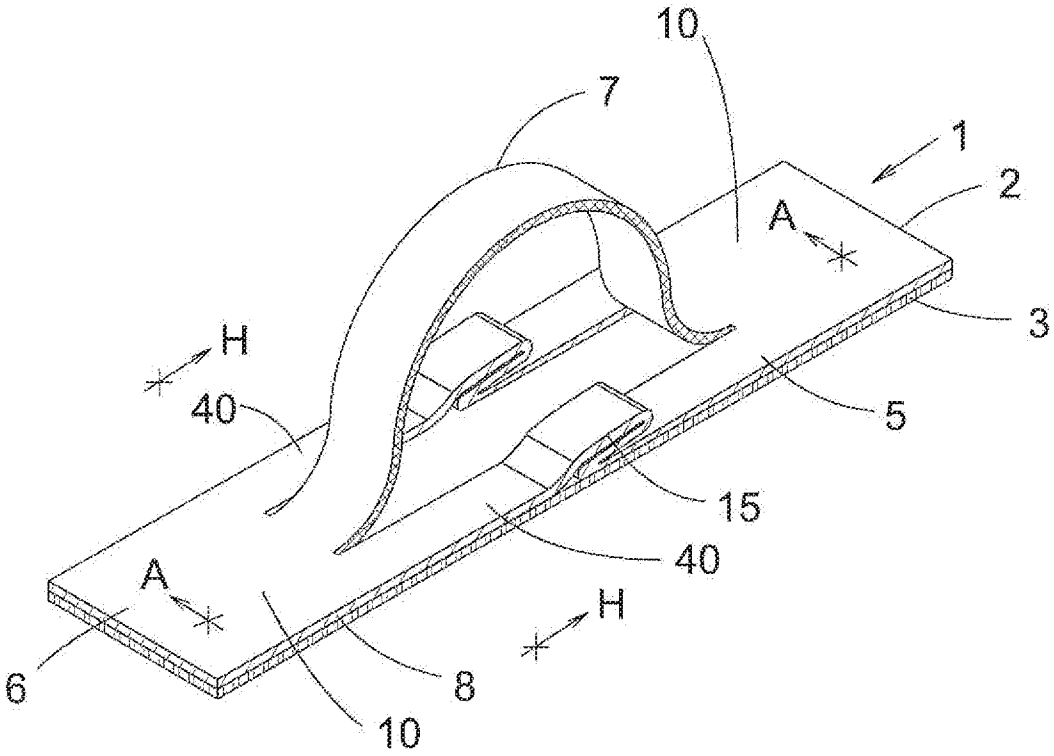
FIG. 3 is a perspective view of a first embodiment of a discrete handle for containers.
Figure 3A:
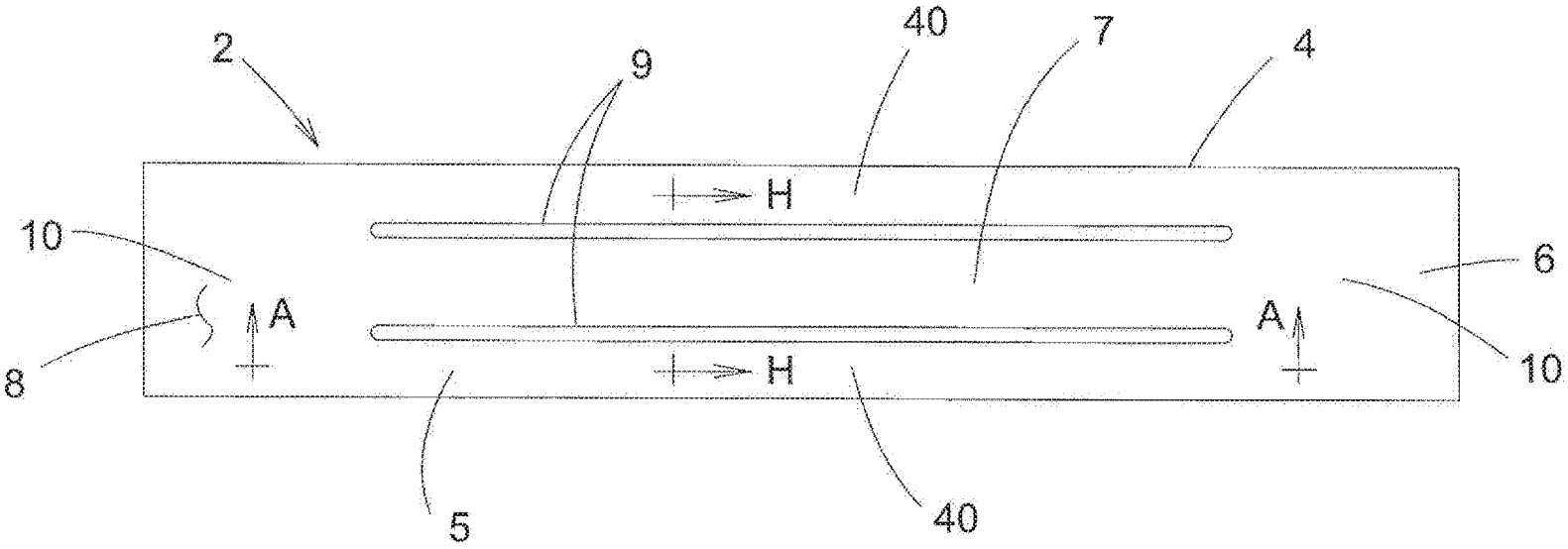
FIG. 3A is an elevation view of the flat pattern of the load bearing element 2 of FIG. 3.

FIG. 3 shows a first exemplary discrete handle 1 comprising a load bearing element 2 and a base element 3. FIG. 3A shows the load bearing element 2 in its elongated, flat configuration comprising of a thin, planar, quadrilateral platform 4 constructed of a unity piece of tear resistant material such as a film or laminated web, which is cut into the desired shape. The load bearing element 2 has an outer perimeter area 5, a top surface 6, a bottom surface 8, and two elongated openings, slots, cuts, or slits 9 (generally referred to as openings) that pass through the element 2 between the top and bottom surface. The openings 9 extend lengthwise between two opposing end portions 10 and can have any width, including no width (e.g., a slit/cut). The two openings 9 define a strap 7 that is positioned between the openings 9 and extends lengthwise between the two end portions 10. The two openings 9 also define two lateral portions 40 that are positioned on other either lateral side of the strap and also extend lengthwise between the two strap ends 10. The lateral portions 40 and the end portions 10 define the outer perimeter area 5 of the load bearing element 2.

Figure 3B:
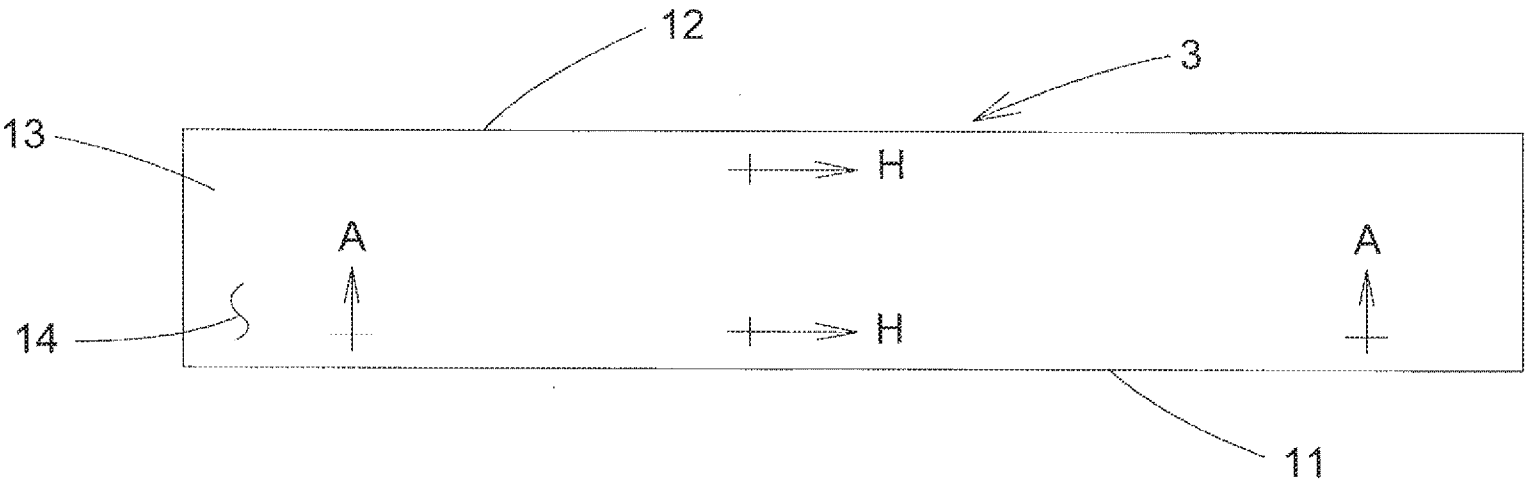
FIG. 3B is an elevation view of the flat pattern of the base element 3 of FIG. 3.

FIG. 3B shows the base element 3 in isolation, which comprises a thin, planar, generally quadrilateral platform 11 constructed of a unity piece of material, such as a plastic film, tape, or paperboard. The platform 11 defines an outer perimeter 12, a top surface 13, and a bottom surface 14.

The longitudinal length of the load bearing element 2 in its flat, elongated form can be longer, such as by between a ¼ inch and 2 inches, than the longitudinal length of the base element 3 before the two elements are secured together. The longitudinal length of the load bearing element 2 can be about equal to the longitudinal length of the base element 3 when they are secured together. For example, the longitudinal length of the load bearing element 2 when flattened and elongated can be in a range from 6 inches to 14 inches, while the longitudinal length of the base element 3 can be in a range from 4 inches to 12 inches. The widths of the load bearing element 2 and the base element 3 can be about equal, such as from 1 inch to 5 inches in some examples. The longitudinal length of the strap 7 in its flat pattern can be in a range from 4 inches to 10 inches, for example, and its width can be in a range from ⅜ inch to 2 inches. These provided dimensions are only examples, and other embodiments can have any sizes and scale.

In an exemplary method of constructing the discrete handle 1, the load bearing element 2 in its flat form (FIG. 3A) can be shortened in the longitudinal direction indicated by arrow H-H intersecting the strap 7 and lateral portions 40 so that the two end portions 10 move toward each other and so that its outer perimeter 5 is generally congruent with the outer perimeter 12 of the base element 3. Shortening the load bearing element 2 causes the strap 7 and lateral portions 40 to have excess material and/or to buckle out of plane. The bottom surface 8 of the load bearing element 2 around the outer perimeter 5 can then be secured to the top surface 13 of the base element 3 around its outer perimeter 12. For example, securing the mating perimeters of the elements can be accomplished through bonding with adhesive, induction welding, RF sealing, or the like, depending on the material composition of the load bearing element 2 and base element 3.

Figure 4:
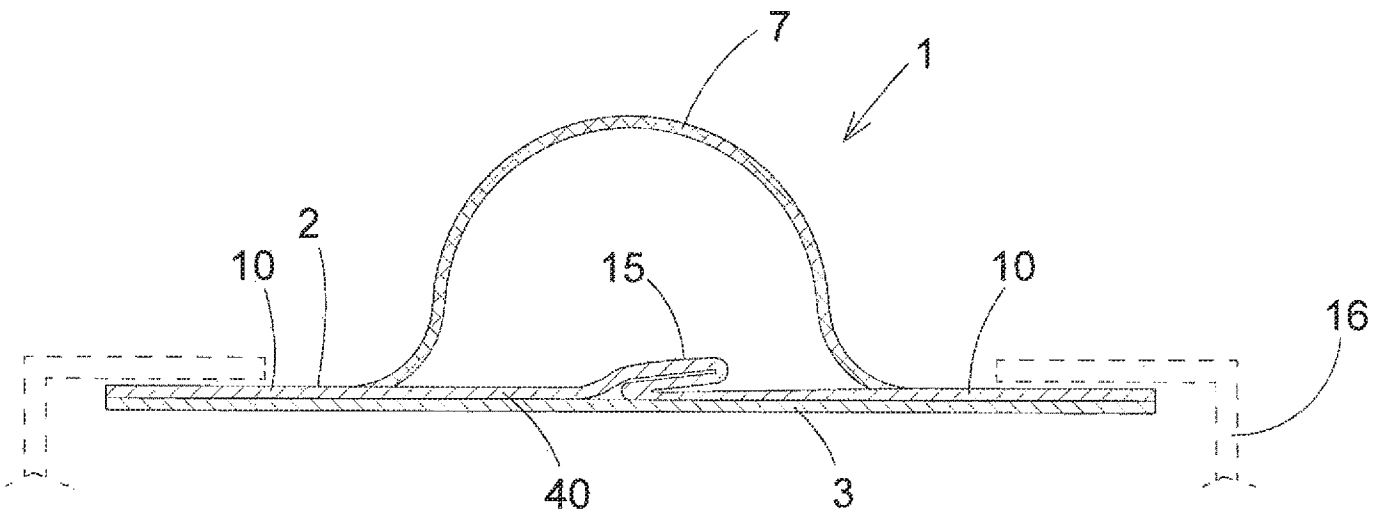
FIG. 4 is a cross-section view taken substantially along the plane indicated by line A-A in FIG. 3
Figure 5:
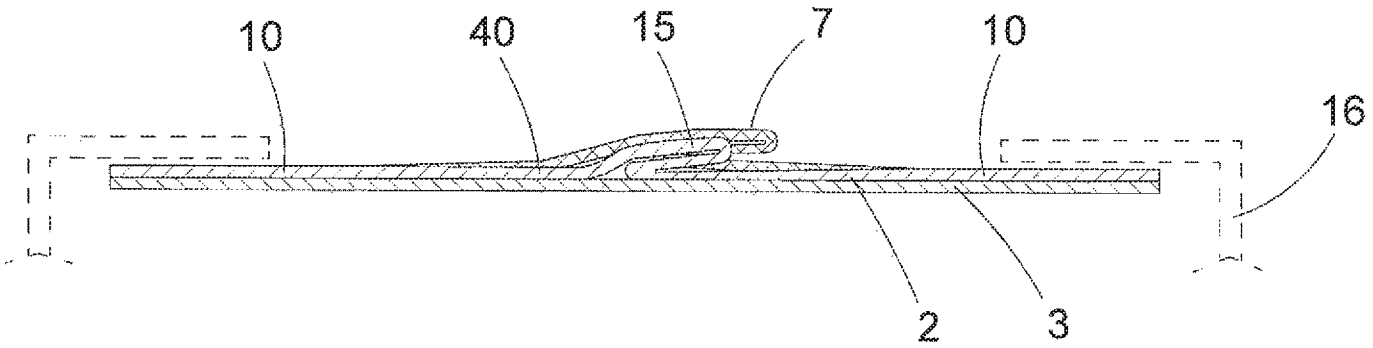
FIG. 5 is a cross-section view taken substantially along the plane indicated by line A-A in FIG. 3 with the strap of the handle in the retracted position.

The strap 7 of the load bearing element 2 is not secured to the base 3 over at least a portion of the strap to allow it to be lifted from the base for use as a hand grip to carry an associated container. The excess length in the strap allows it to bow upwardly out of plane for use as a handle (FIG. 4) and the excess length can be folded over to a flattened position when not used as a handle (FIG. 5).

Figure 6:
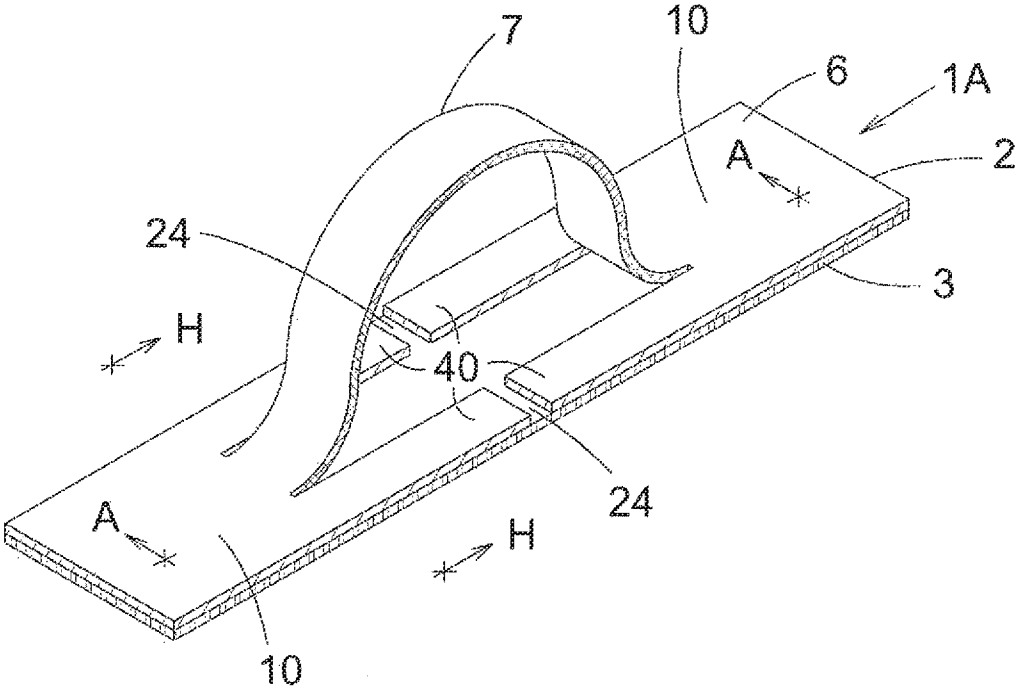
FIG. 6 is a perspective view of a second exemplary discrete handle for containers.

The excess material in the lateral portions 40 can form folds or pleats 15 (see FIG. 3) that are folded down flat against the top of the lateral portions. The folds can be bent at two or more laterally extending fold lines, as shown. The folded portions can be secured to lie flat. In other embodiments, the excess material in the lateral portions 40 can be cut off, such that each lateral portion forms two sections (i.e., four lateral portions) with opposing free ends at the cut locations. The free ends can abut each other to form a generally smooth, continuous, flat perimeter. In other embodiments, the free ends can be spaced from each other, forming gaps that pass laterally through the perimeter and join with the two lengthwise openings 9 (similar to what is shown in FIG. 6). The bottom surfaces of the lateral portions 40 are secured to the base element 3.

Figure 6A:
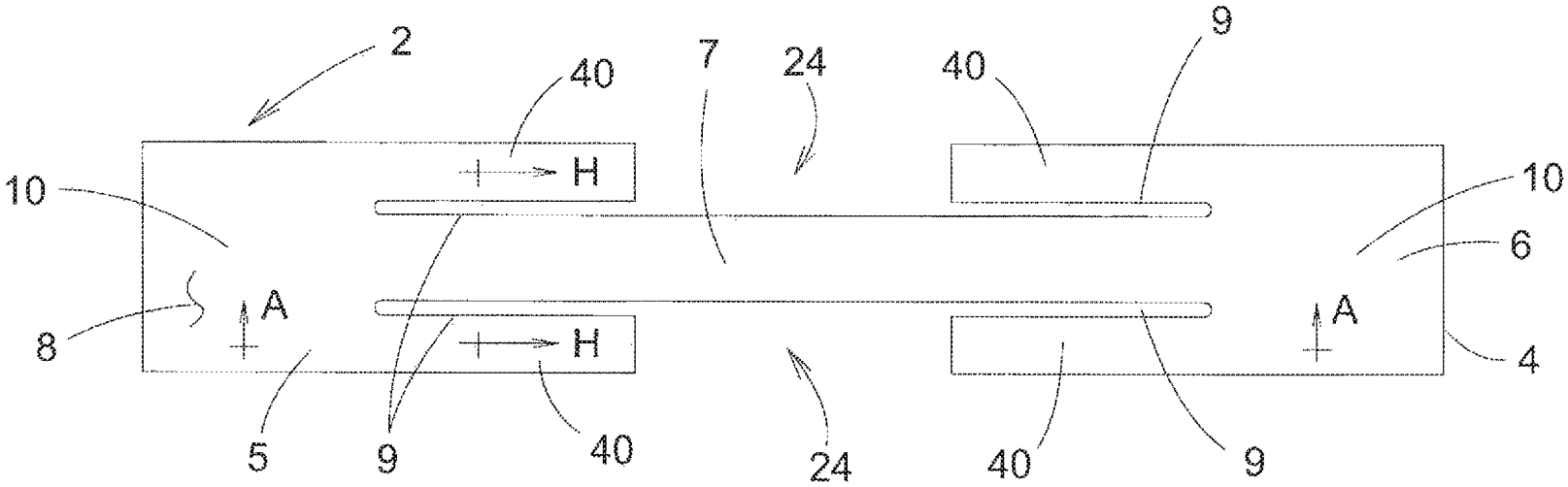
FIG. 6A is an elevation view of a flat pattern of the handle load bearing element in FIG. 6.

FIG. 6 shows a second exemplary discrete handle 1A comprising a load bearing element 2 and a base element 3. FIG. 6A shows the load bearing element 2 in its elongated, flat configuration comprising of a thin, planar platform 4 constructed of a unity piece of tear resistant material such as a film or laminated web, which is cut into the desired shape. The load bearing element 2 has an outer perimeter area 5, a top surface 6, a bottom surface 8, and four elongated openings, slots, cuts, or slits 9 (generally referred to as openings) that pass through the element 2 between the top and bottom surface. The openings 9 extend lengthwise between two opposing end portions 10 and can have any width, including no width (e.g., a slit/cut). Between the openings 9 is a strap 7 that extends lengthwise between the two end portions 10. The openings 9 also define four lateral portions 40 that are positioned on other either lateral side of the strap 7 and extend lengthwise from the two strap ends 10. Each pair of lateral portions 40 are spaced apart longitudinally by a gap 24 between their free ends. The lateral portions 40 and the end portions 10 define the outer perimeter area 5 of the load bearing element 2.

The base element 3 comprises a thin, planar, generally quadrilateral platform 11 constructed of a unity piece of material, such as a plastic film, tape, or paperboard. The platform 11 defines an outer perimeter 12, a top surface 13, and a bottom surface 14, as illustrated in FIG. 3B.

The dimensions of the load bearing element 2 and base element 3 of the discrete handle 1A can be similar to those provided herein for the discrete handle 1.

In an exemplary method of constructing the discrete handle 1A, the load bearing element 2 in its flat form (FIG. 6A) can be shortened in the longitudinal direction indicated by arrow H-H intersecting the strap 7 and lateral portions 40 so that the two end portions 10 move toward each other and so that its outer perimeter 5 is generally congruent with the outer perimeter 12 of the base element 3. Shortening the load bearing element 2 causes the strap 7 to have excess material and/or to buckle out of plane, and causes the lateral portions 40 to move toward each other, closing or reducing the gaps 24. The bottom surface 8 of the load bearing element 2 around the outer perimeter 5 can then be secured to the top surface 13 of the base element 3 around its outer perimeter 12. For example, securing the mating perimeters of the elements can be accomplished through bonding with adhesive, induction welding, ultrasonic welding, RF sealing/welding, or the like, depending on the material composition of the load bearing element 2 and base element 3.

Figure 7:
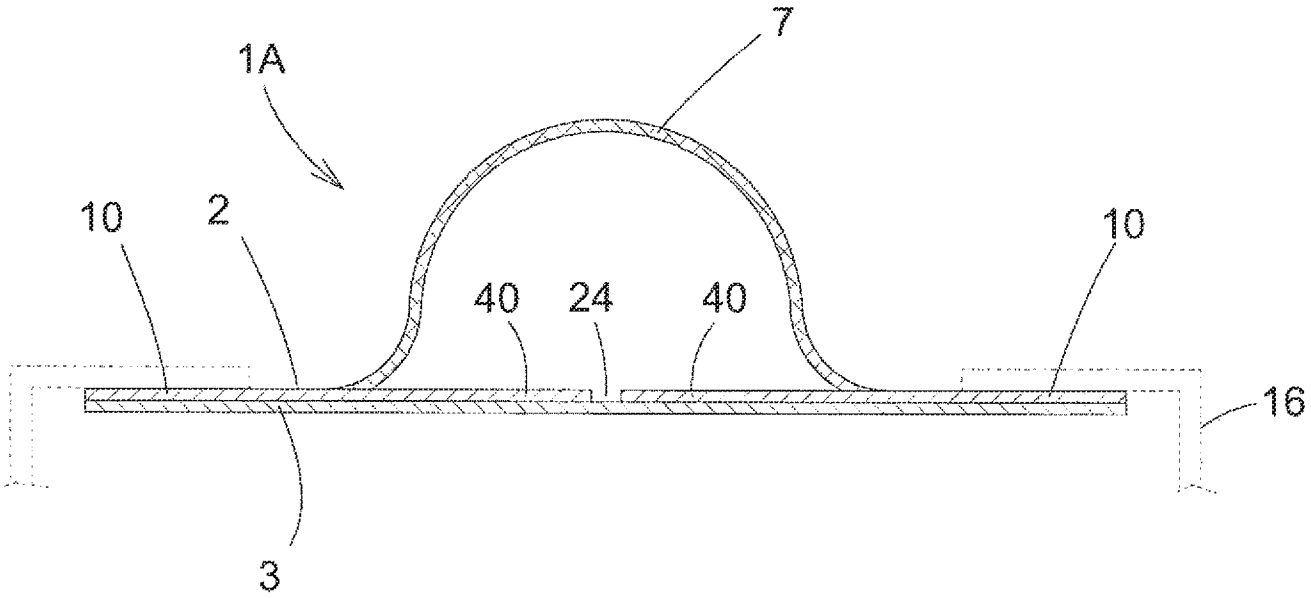
FIG. 7 is a cross-section view taken substantially along the plane indicated by line A-A of FIG. 6
Figure 8:
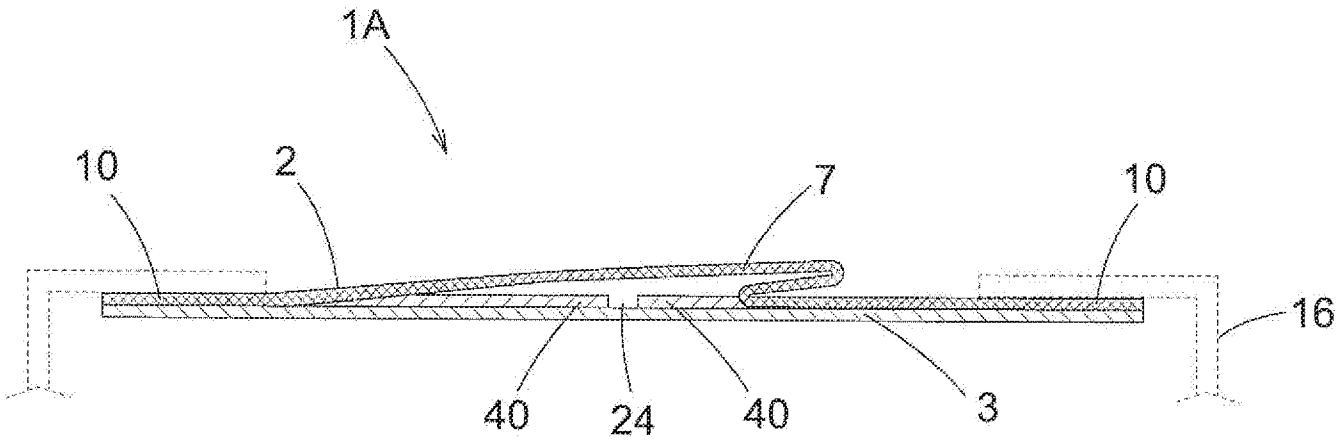
FIG. 8 is a cross-section view taken substantially along the plane indicated by line A-A in FIG. 6 with the strap of the handle in the retracted position.

The strap 7 of the load bearing element 2 is not secured to the base 3 over at least a portion of the strap to allow it to be lifted from the base for use as a hand grip to carry an associated container. The excess length in the strap allows it to bow upwardly out of plane for use as a handle (FIG. 7) and the excess length can be folded over to a flattened position when not used as a handle (FIG. 8).

The four lateral portions 40 can move toward each other on either lateral side of the strap 7 such that their free ends can abut each other to form a generally smooth, continuous, flat perimeter. In other embodiments, the free ends can remain spaced from each other leaving reduced gaps 24 that pass laterally through the perimeter and join with the lengthwise openings 9 (as shown in FIG. 6). The bottom surfaces of the lateral portions 40 are secured to the base element 3.

Figure 9:
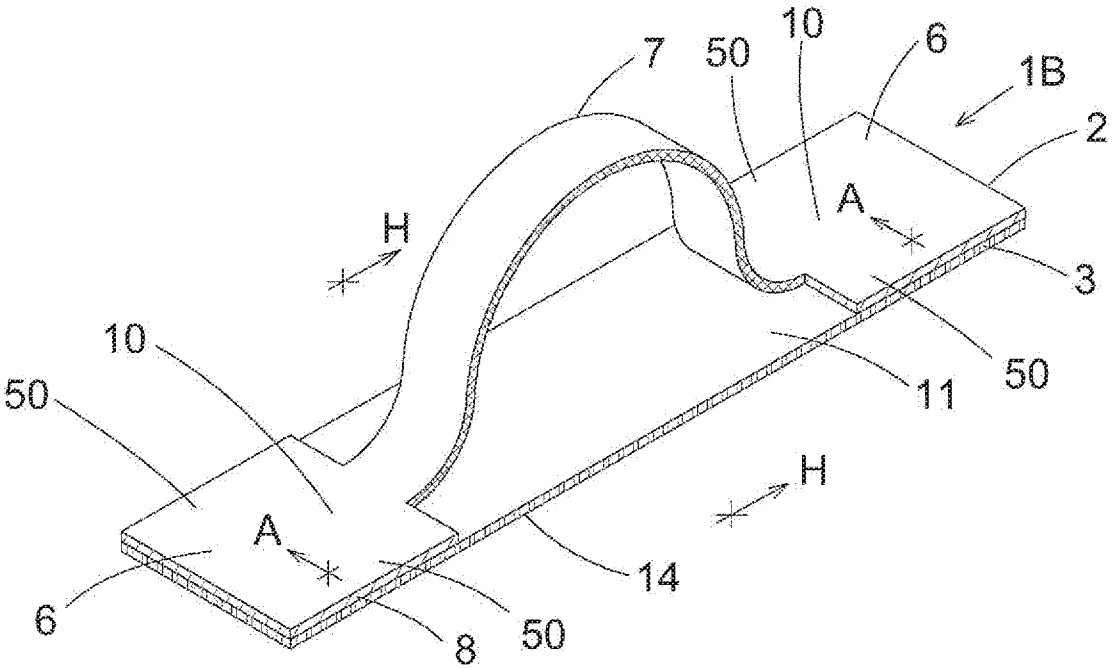
FIG. 9 is a perspective view of a third exemplary discrete handle for containers.
Figure 9A:
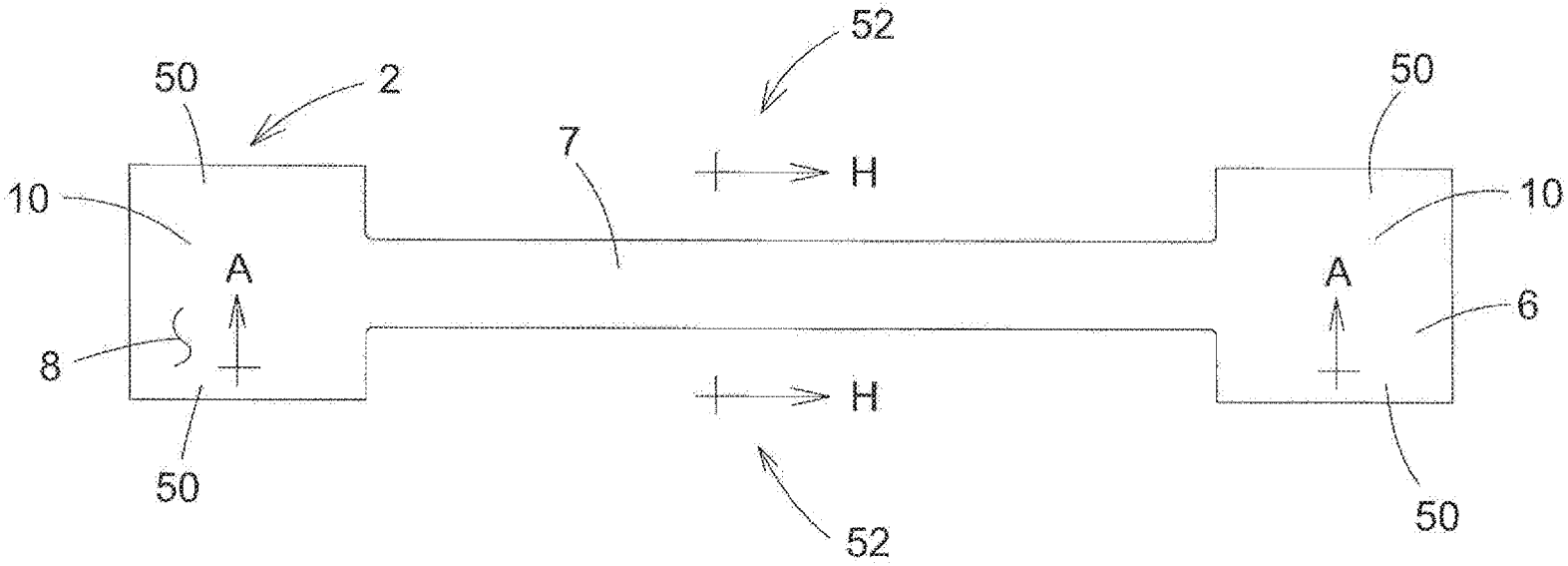
FIG. 9A is an elevation view of the flat pattern of the handle load bearing element in FIG. 9.

FIG. 9 shows a third exemplary discrete handle 1B comprising a load bearing element 2 and a base element 3. FIG. 9A shows the load bearing element 2 in its elongated, flat configuration comprising of a thin, planar platform constructed of a unity piece of tear resistant material such as a film or laminated web, which is cut into the desired shape. The load bearing element 2 has a top surface 6 and a bottom surface 8. The load bearing element 2 includes two end portions 10 and a strap 7 that extends lengthwise between the two end portions 10. The strap 7 has a width that is narrower than the widths of the two end portions 10, such that two lateral cutouts 52 are formed on either side of the strap 7. The end portions 10 includes lateral projections 50 that extend laterally on both sides of the strap 7, such that the end portions are wider than the strap and extend laterally beyond both lateral sides of the strap. The lateral projections 50 are spaced apart by the cutouts 52. The load bearing element 2 of the discrete handle 1B can thus have a general "dog bone" shape or "dumb bell" shape.

The base element 3 comprises a thin, planar, generally quadrilateral platform 11 constructed of a unity piece of material, such as a plastic film, tape, or paperboard. The platform 11 defines an outer perimeter 12, a top surface 13, and a bottom surface 14, as illustrated in FIG. 3B.

The dimensions of the load bearing element 2 and base element 3 of the discrete handle 1B can be similar to those provided herein for the discrete handle 1.

In an exemplary method of constructing the discrete handle 1B, the load bearing element 2 in its flat form (FIG. 9A) can be shortened in the longitudinal direction indicated by arrow H-H intersecting the strap 7 so that the two end portions 10 move toward each other and so that the end portions 10 are generally congruent with the outer perimeter 12 of the base element 3. Shortening the load bearing element 2 causes the strap 7 to have excess material and/or to buckle out of plane, and causes the lateral projections 50 to move toward each other, reducing the length of the cutouts 52. The bottom surface 8 of the load bearing element 2 at the end portions 10 can then be secured to the top surface 13 of the base element 3. For example, securing the mating surfaces of the elements can be accomplished through bonding with adhesive, induction welding, RF sealing, or the like, depending on the material composition of the load bearing element 2 and base element 3.

Figure 10:
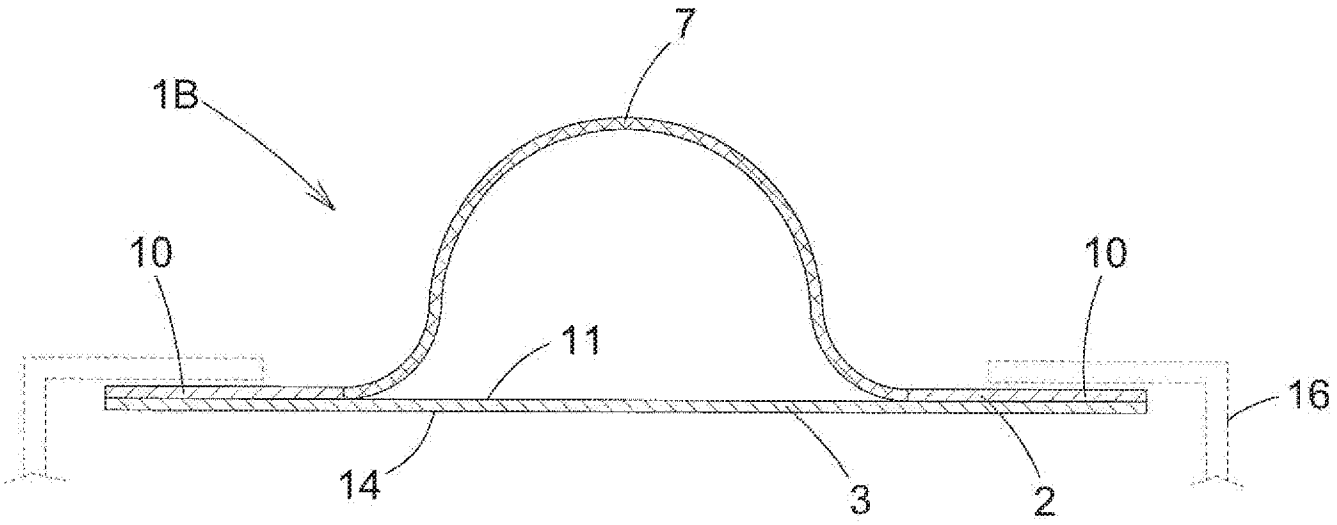
FIG. 10 is a cross-section view taken substantially along the plane indicated by line A-A in FIG. 9
Figure 11:
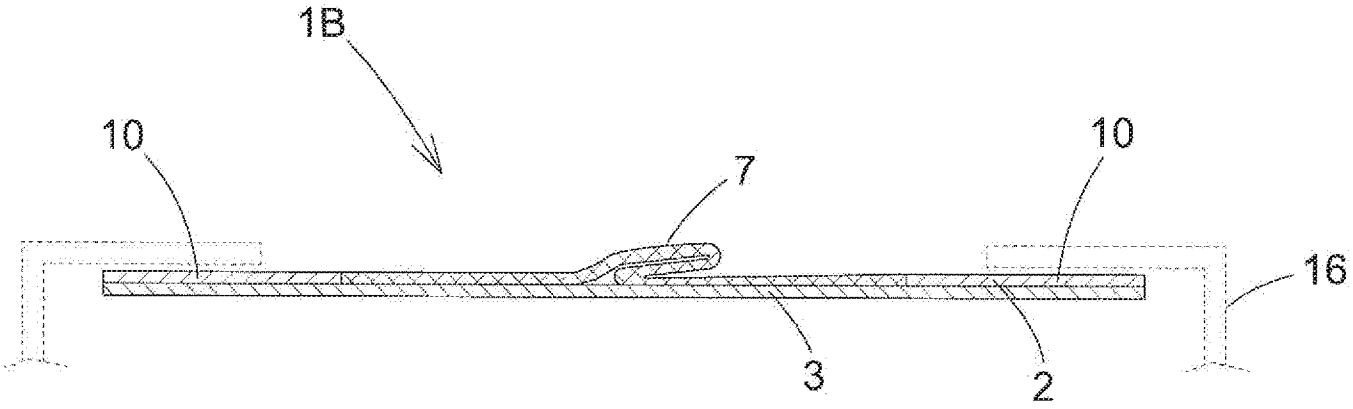
FIG. 11 is a cross-section view taken substantially along the plane indicated by line A-A in FIG. 9 with the strap of the handle in the retracted position.
Figure 11A:
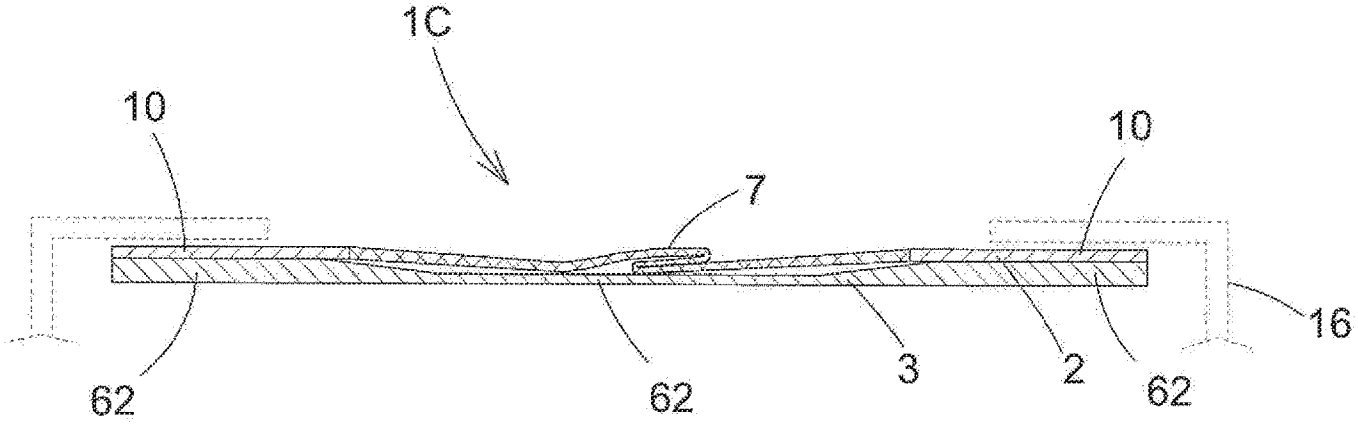
FIG. 11A is a cross-section view taken substantially along the plane indicated by line A-A in FIG. 9, with the strap of the handle in a retracted and compressed position.

The strap 7 of the load bearing element 2 is not secured to the base 3 over at least a portion of the strap to allow it to be lifted from the base for use as a hand grip to carry an associated container. The excess length in the strap allows it to bow upwardly out of plane for use as a handle (FIG. 10) and the excess length can be folded over to a flattened position when not used as a handle (FIG. 11 and FIG. 11A).

The material for forming the load bearing element 2 of the discrete handles disclosed herein may be a non-woven fiber, film, tape, paperboard, scrim, woven fiber, PVC coated web, cloth, or any combination thereof (e.g., a composite laminate). The material may include, but is not limited to, various ribbon materials, various web materials, and various widths and lengths of material. The materials may include films, non-woven materials, paper materials, composite, and laminated films. Particularly preferred are flexible materials where the strap 7 can form a handle. The material, for example, may generally have a thickness in a range from about 0.25 mm (0.01 in) to about 4 mm (0.16 in), and may be comprised of a polymeric web selected from the group comprising polyester, polypropylene, polyethylene, laminates, and combinations thereof.

Other means to secure the mating perimeters of the handle elements can include any one or more of the following: an adhesive such as a hot melt adhesive, a pressure sensitive adhesive, a remoistenable adhesive, a heat activated adhesive, a hot melt pressure sensitive adhesive, a hot melt remoistenable adhesive, a water dispersible hot melt adhesive, a biodegradable hot melt adhesive, a repulpable hot melt adhesive, a non-hot melt adhesive, a two-part epoxy-based structural adhesive, an polyvinyl alcohol adhesive, and/or an adhesive based on renewable resources. Examples adhesives include any hot melt adhesive such as an ethylene-vinyl acetate copolymer (EVA-based) hot melt adhesive; EMA-based hot melt adhesive (ethylene methylacrylate); EnBA-based hot melt adhesive (ethylene n-butyl acrylate); hot melt adhesive based on polyamides; hot melt remoistenable adhesive based on polyamides and copolyesters; hot melt adhesives based on polyethylene and polypropylene homopolymers, copolymers and interpolymers, rubbery block copolymer hot melt adhesives; or RF (radio frequency) activatable adhesives. Exemplary epoxy resins can comprise monomeric, dimeric, oligomeric, or polymeric epoxy materials, and/or can comprise at least one curable epoxy resin and at least one amine curing agent. Exemplary renewable resource adhesives can include a thermoplastic hot melt or a pressure sensitive adhesive.

Figure 20:
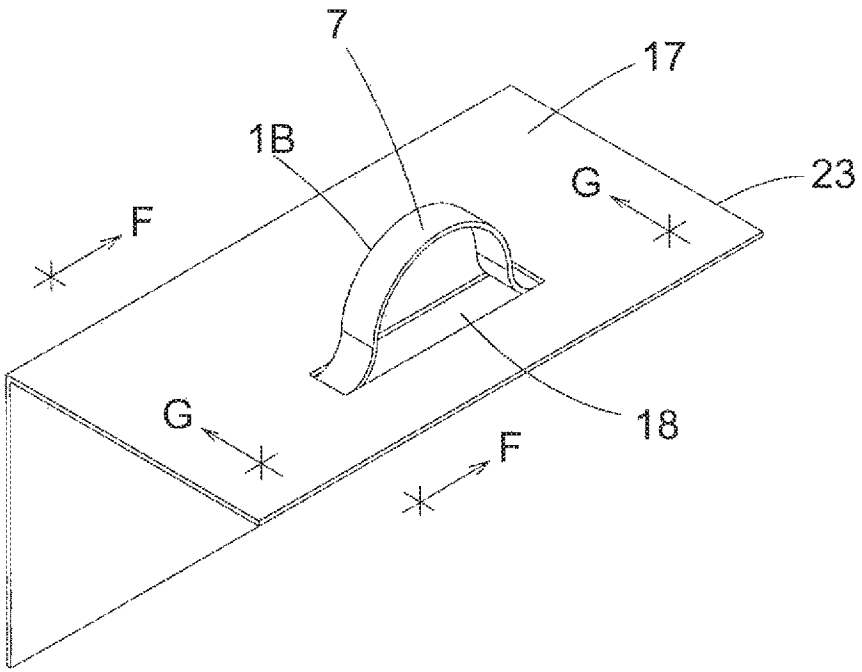
FIG. 20 is a perspective view of the handle of FIG. 9 attached to a container.
Figure 21:
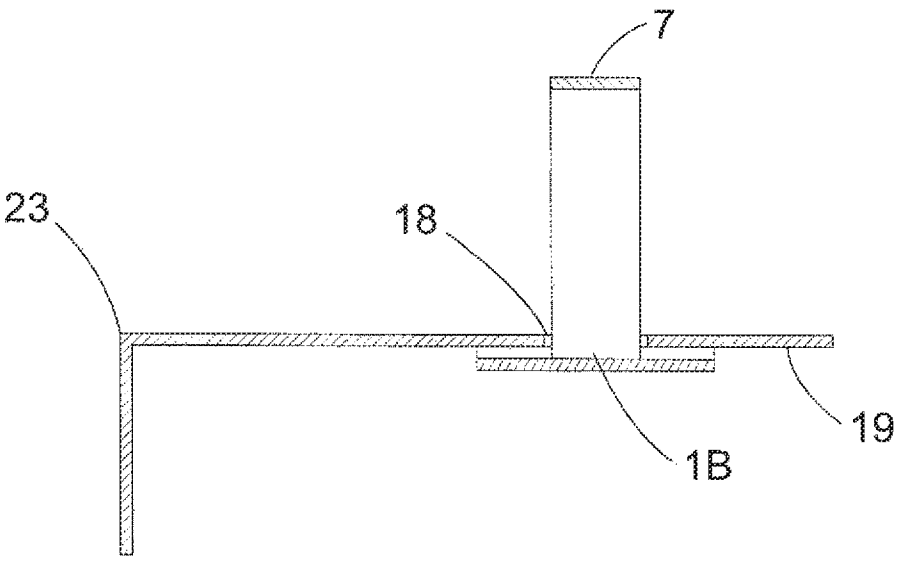
FIG. 21 is a cross-sectional view taken substantially along the plane indicated by line F-F in FIG. 20
Figure 22:
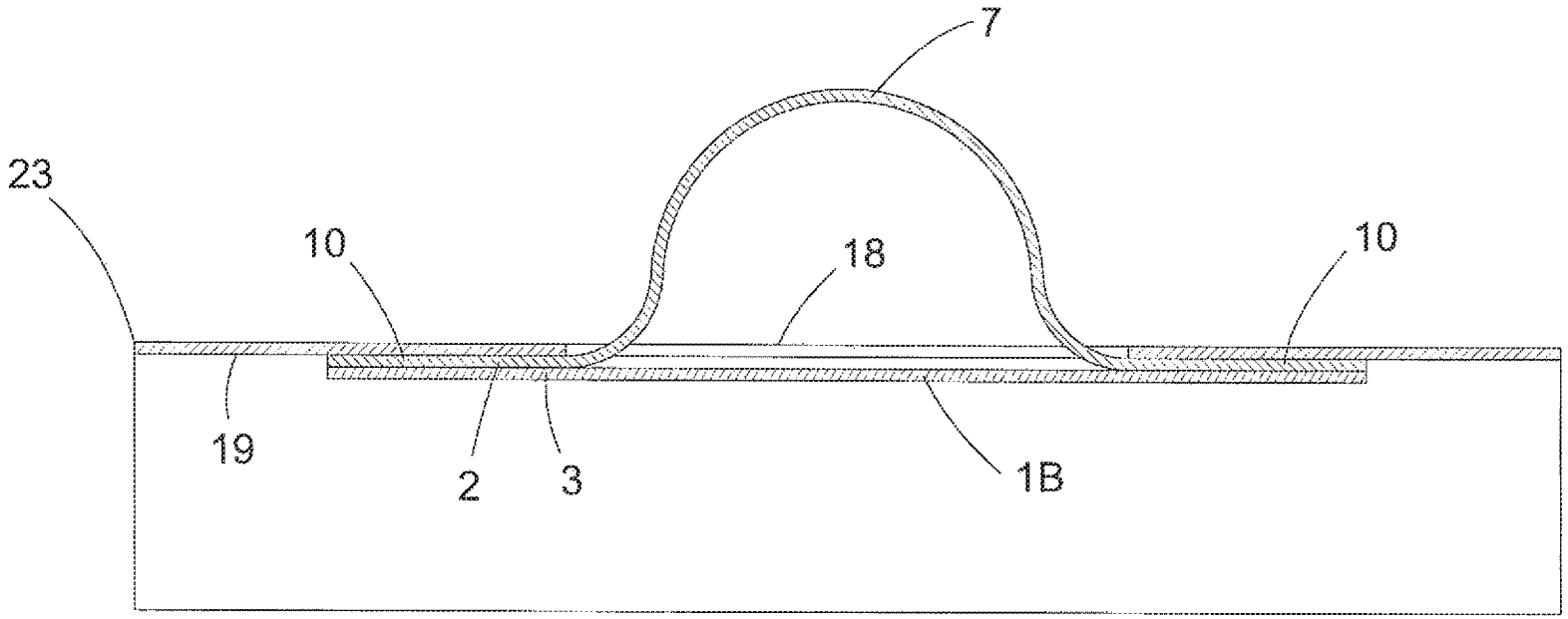
FIG. 22 is a cross-sectional view taken substantially along the plane indicated by line G-G in FIG. 20

FIGS. 12-23 illustrate the disclosed discrete handles incorporated onto an exemplary container 16. Referring to the figures in detail, wherein like alpha-numericals indicate like elements throughout the several views, a container 16 is provided with a top 17. In FIGS. 12-15, the longitudinal direction of the container is indicated by arrow B, the axial or width direction of the container is indicated by arrow C. In FIGS. 16-19, the longitudinal direction of the container is indicated by arrow D; the axial or width direction of the container is indicated by arrow E. In FIGS. 20-22, the longitudinal direction of the container is indicated by arrow F, the axial or width direction of the container is indicated by arrow G.

Figure 12:
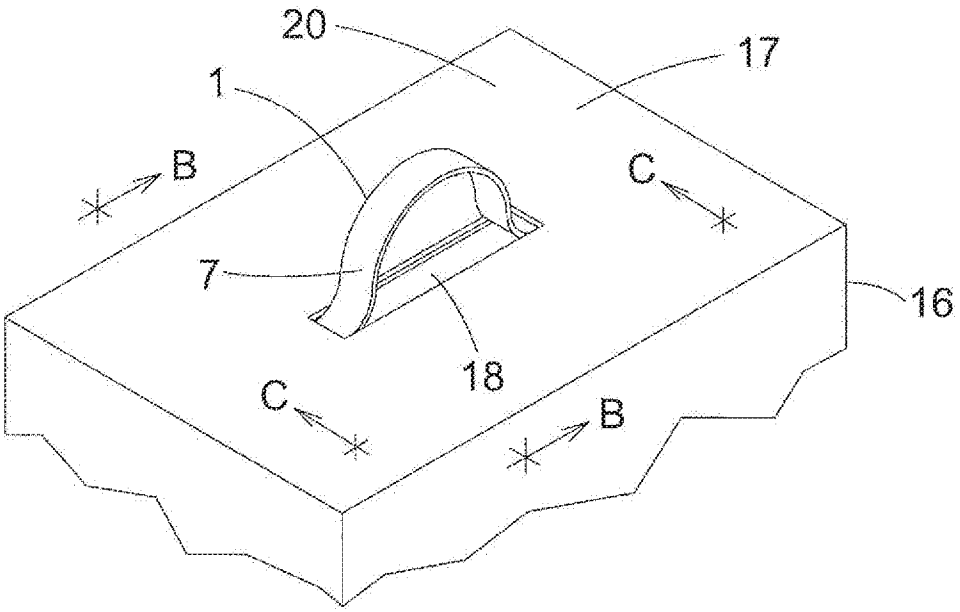
FIG. 12 is a perspective view of the handle of FIG. 3 attached to a container.
Figure 13:
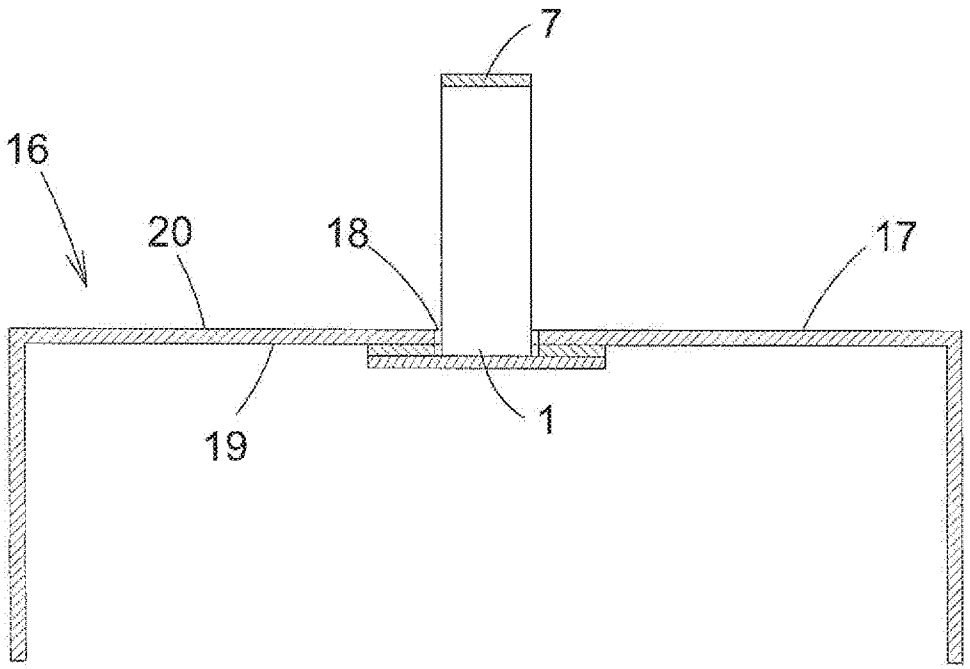
FIG. 13 is a cross-sectional view taken substantially along the plane indicated by line B-B in FIG. 12
Figure 14:
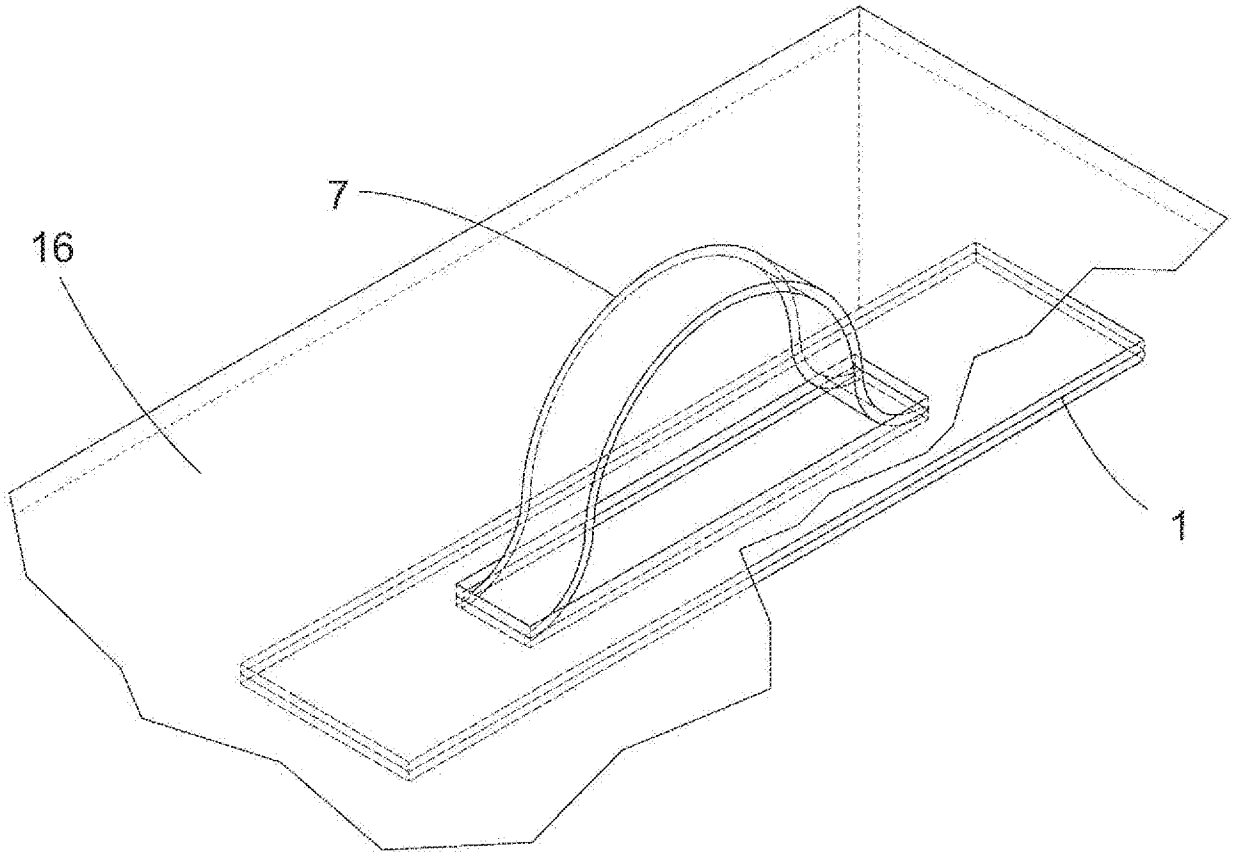
FIG. 14 is a perspective view, with portions partially broken away, of the handle construction of the package of FIG. 12
Figure 15:
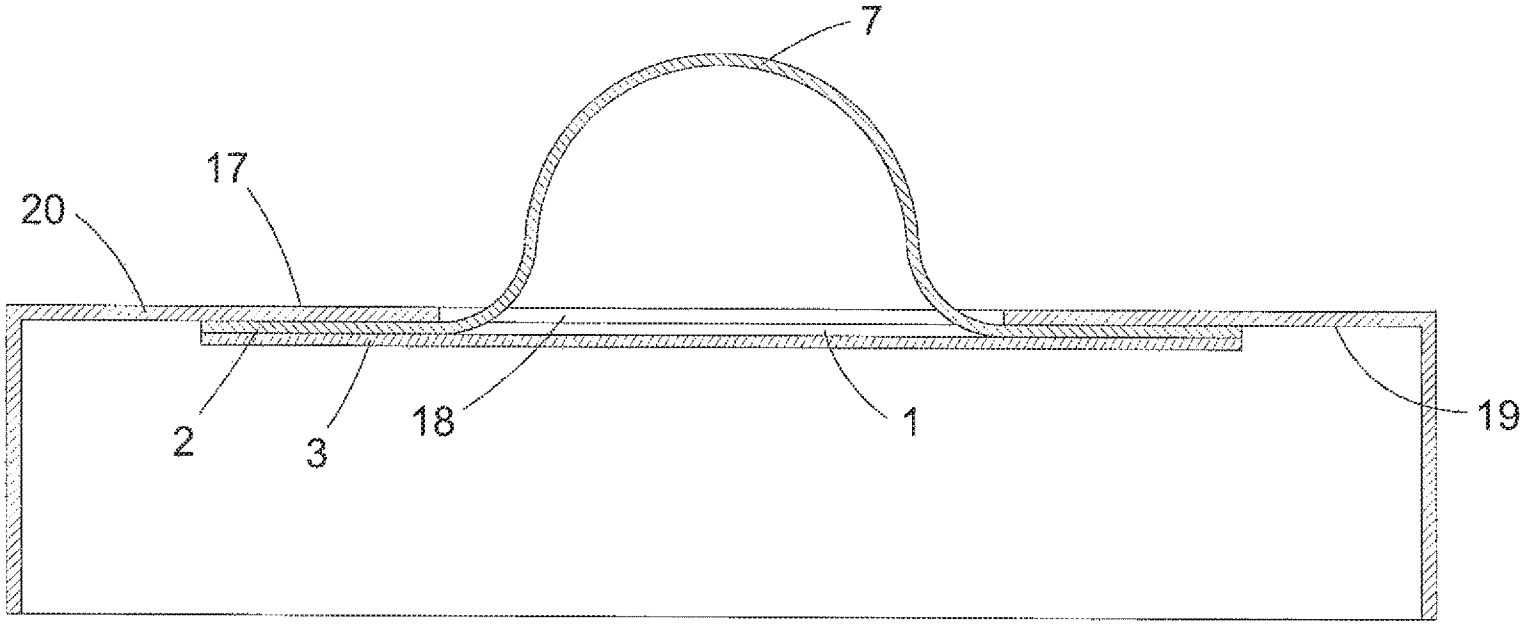
FIG. 15 is a cross-sectional view taken substantially along the plane indicated by line C-C in FIG. 12
Figure 16:
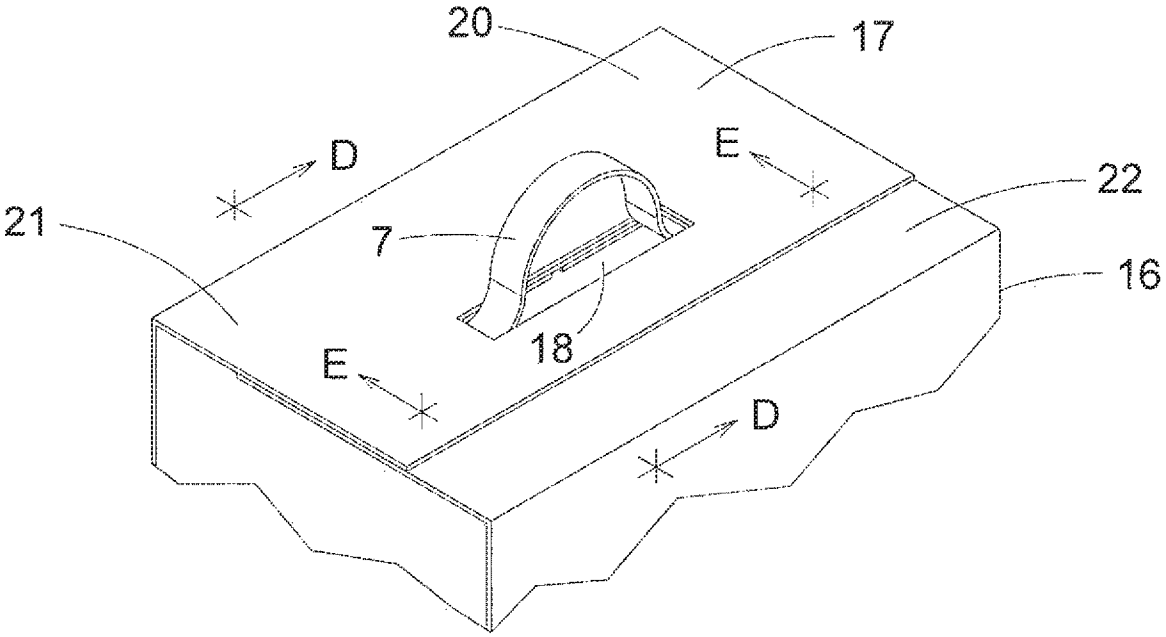
FIG. 16 is a perspective view of the handle of FIG. 6 attached to a container.
Figure 17:
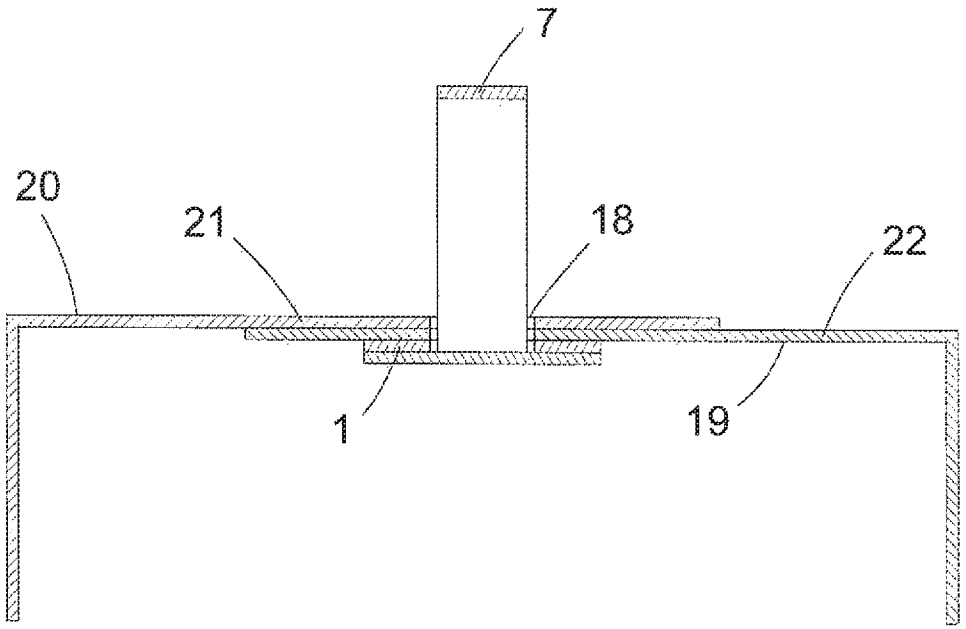
FIG. 17 is a cross-sectional view taken substantially along the plane indicated by line D-D in FIG. 16
Figure 18:
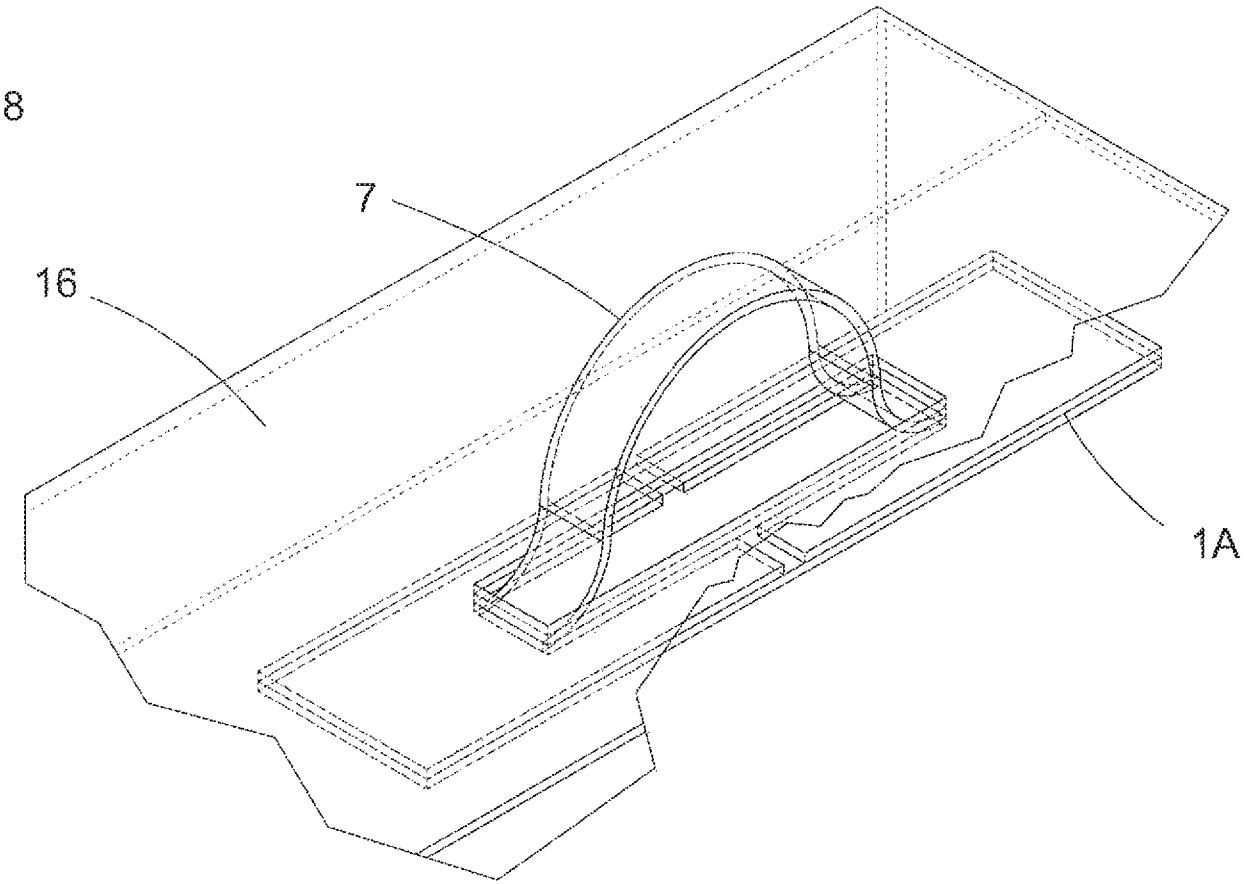
FIG. 18 is a perspective view, with portions partially broken away, of the handle construction of the package of FIG. 16
Figure 19:
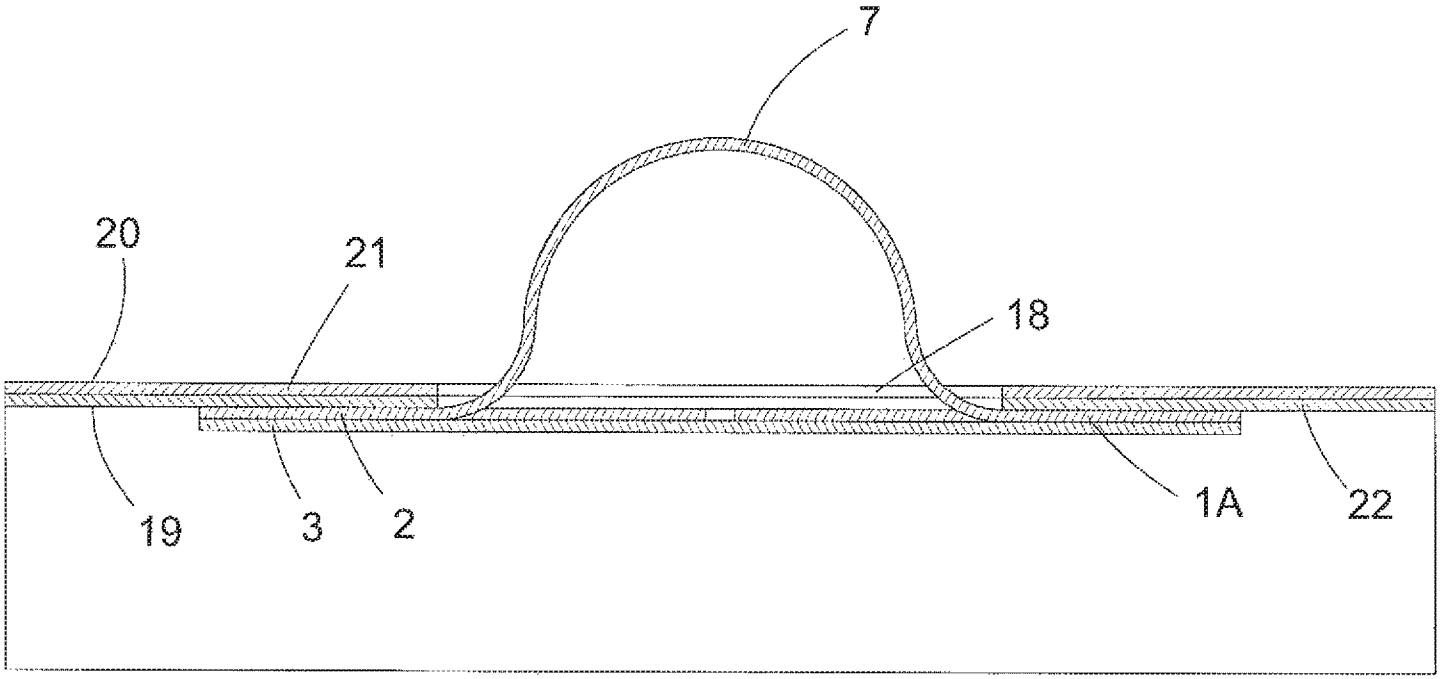
FIG. 19 is a cross-sectional view taken substantially along the plane indicated by line E-E in FIG. 16

The container 16 can be constructed of corrugated or folding carton paperboard, or other materials. The top 17 has a generally centrally located, longitudinally-elongated opening 18. As shown in FIG. 13, adhesively affixed to an interior surface 19 of the top is the discrete handle 1 (or similarly the top of discrete handle 1A, 1B, or any other discrete handled disclosed herein). Container 16 also defines an exterior surface 20 opposing interior surface 19. As shown in FIG. 14, the handle strap 7 can be extended upward through the opening 18 of the container to allow a hand there through to carry the container 16. As shown in FIG. 15, the top surface 6 of the handle is secured to the interior surface 19 of the container. As shown in FIG. 12, there can be a single longitudinally-elongated opening 18 per handle, and the strap 7 extends the partial or full length of the opening 18. In certain embodiments, the opening 18 has a rectilinear shape.

The base element 3 of the handle can preclude particles, fluids, or contaminants from entering or exiting container 16 through opening 18. In use, the strap 7 can be extended and raised upward through opening 18 where it can be grasped by the hand to carry the package.

As shown in FIGS. 16-19, a container 16 can have a top 17 formed from two or more overlapping flaps (e.g., illustrated flaps 21 and 22), which can be connected together for example via an adhesive. Closure flaps 21 and 22 can have overlapping longitudinally-elongated openings 18. Connected to an interior surface 19 of the inner flap 22 is a discrete handle (e.g., the discrete handle 1, 1A, 1B or any other discrete handle described herein). The handle strap 7 can be extended upward through the openings 18 of both flaps 21 and 22 to allow a user to grip the strap and carry the container 16. In this embodiment the base element 3 of the handle precludes particles, fluids, or contaminants from entering or exiting container 16 through complementary openings 18 in the top flaps 21 and 22. In use, the strap 7 enables it to be extended and raised upward through complementary opening 18 where it can be grasped by the hand to carry the package.

In FIGS. 20-22, a substrate 23 has a centrally located, elongated opening 18. Connected to an inner surface 19 of the substrate 23 is a discrete handle (e.g., the discrete handle 1, 1A, 1B, or any other discrete handle disclosed herein). The handle strap 7 can be extended upward through the opening 18 of the substrate 23 to allow a hand there through to carry the substrate 23. The top surface 6 of the load bearing element 2 of the handle is secured to the interior surface 19 of the substrate 23. As shown in FIG. 20, there is a single longitudinally-elongated opening 18 per handle and the strap 7 extends the partial or full length of the opening 18. In certain embodiments, the opening 18 has a rectilinear shape.

Figure 23:
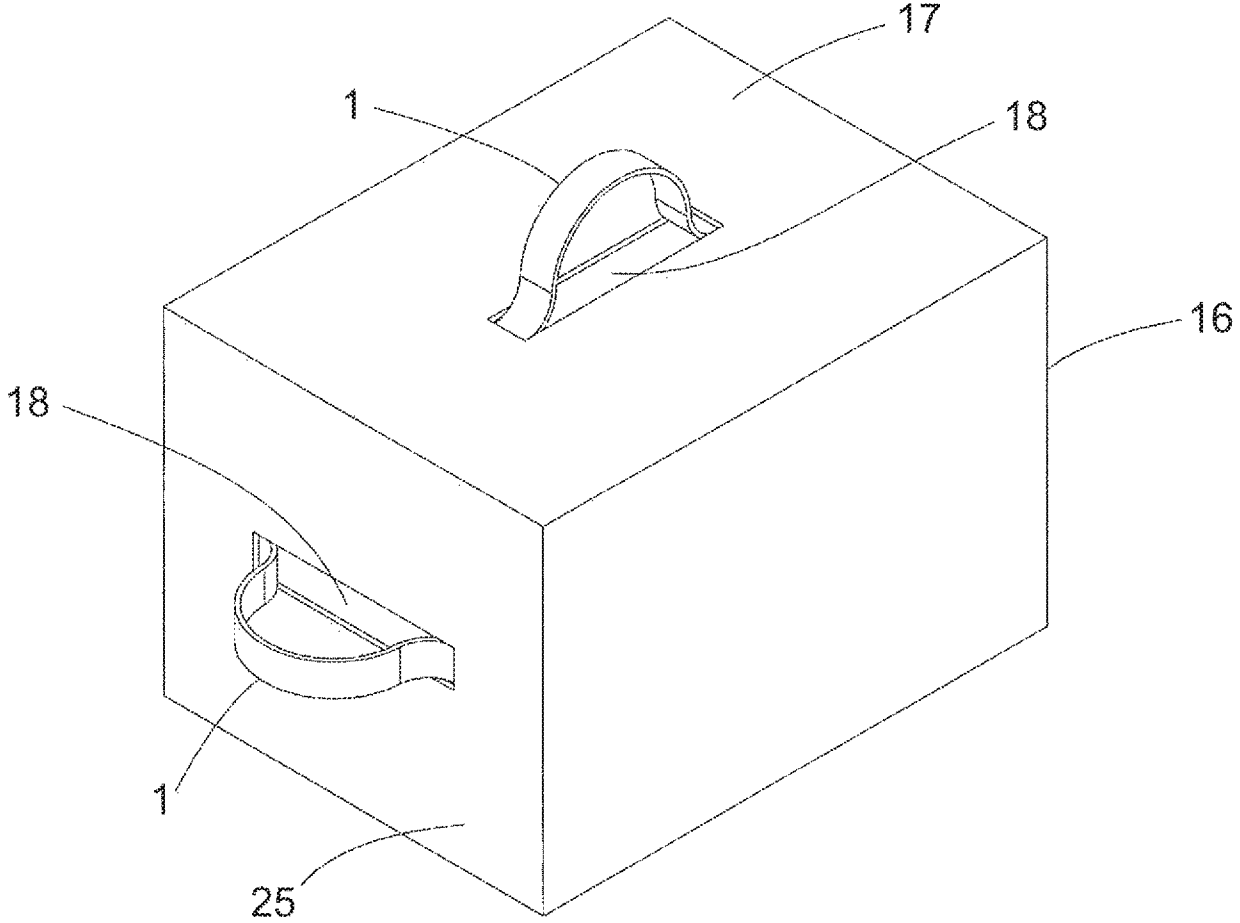
FIG. 23 is a perspective view of a container with two handles attached to a container.

In FIG. 23, a container 16 is provided with a top 17 and side 25. The container 16 can be constructed of corrugated or folding carton paperboard, or other material. Connected to an interior surfaces of the top 17 and side 25 are two discrete handles (e.g., handles 1, 1A, or 1B). The handle straps 7 can be extended outward through the openings 18 of the container to allow a user to carry the container 16.

In certain embodiments the strap 7 of the discrete handle can function as a strap for suspending a container on a hook, pulling the container, or restraining the container.

The disclosed handles may be applied to the substrate by any means. One illustrative method involves providing at least one longitudinally-elongated opening in a panel or flap configurable to form a top, wall or bottom of a container, wherein the panel or flap comprises a paper board and defines an exterior surface and an interior surface; securing the a handle to align the strap with the opening in the panel or flap, wherein the handle comprises a strap that can be extended through the length of the longitudinally-extending opening in the container; and adhesively affixing top surface of the outer perimeter of the handle to the interior surface of the panel or flap.

As used herein, the term "substrate" means any sheet-like material, including films, webs, cellulose material, liners, medians, paper board, carton board, box board, corrugated board, or other sheet material or web material.

For purposes of this description, certain aspects, advantages, and novel features of the embodiments of this disclosure are described herein. The disclosed methods, apparatuses, and systems should not be construed as limiting in any way. Instead, the present disclosure is directed toward all novel and nonobvious features and aspects of the various disclosed embodiments, alone and in various combinations and sub-combinations with one another. The methods, apparatuses, and systems are not limited to any specific aspect or feature or combination thereof, nor do the disclosed embodiments require that any one or more specific advantages be present or problems be solved.

Features, integers, characteristics, materials, or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

Although the operations of some of the disclosed methods are described in a particular, sequential order for convenient presentation, it should be understood that this manner of description encompasses rearrangement, unless a particular ordering is required by specific language. For example, operations described sequentially may in some cases be rearranged or performed concurrently. Moreover, for the sake of simplicity, the attached figures may not show the various ways in which the disclosed methods can be used in conjunction with other methods.

As used herein, the terms "a", "an", and "at least one" encompass one or more of the specified element. That is, if two of a particular element are present, one of these elements is also present and thus "an" element is present. The terms "a plurality of" and "plural" mean two or more of the specified element.

As used herein, the term "and/or" used between the last two of a list of elements means any one or more of the listed elements. For example, the phrase "A, B, and/or C" means "A", "B,", "C", "A and B", "A and C", "B and C", or "A, B, and C."

As used herein, the term "coupled" generally means physically (e.g., mechanically, chemically, adhesively, welded, etc.) coupled or linked and does not exclude the presence of intermediate elements between the coupled items absent specific contrary language.

In view of the many possible embodiments to which the principles of the disclosed technology may be applied, it should be recognized that the illustrated embodiments are only examples and should not be taken as limiting the scope of the disclosure. Rather, the scope of the disclosure is at least as broad as the following claims. We therefore claim all that comes within the scope of these claims.

The invention claimed is:

1. A discrete handle configured to be secured to container, the handle comprising:

a base layer; and a load bearing layer comprising:

a first end portion and a second end portion;

a strap extending lengthwise between the first and second end portions;

a first lateral portion extending lengthwise between the first and second end portions on a first lateral side of the strap;

a second lateral portion extending lengthwise between the first and second end portions on a second lateral side of the strap opposite the first lateral side of the strap;

a first slot extending lengthwise between the first and second end portions and laterally separating the first lateral portion from the strap; and a second slot extending lengthwise between the first and second end portions and laterally separating the second lateral portion from the strap;

wherein an upper surface of the base layer is secured to lower surfaces of the first end portion, the second end portion, the first lateral portion, and the second lateral portion;

wherein upper surfaces of the first end portion, the second end portion, the first lateral portion, and the second lateral portion are configured to be secured to a container to secure the handle to the container;

wherein the strap includes excess length between the first and second end portions allowing the strap to arch upward away from the base layer, such that when the handle is secured to a container the strap can project upwardly from a container and form a grasping region to hold the container; and wherein the first and second lateral portions include folded portions.

2. The handle of claim 1, wherein the folded portions include laterally extending fold lines.

3. The handle of claim 1, wherein the folded portions comprise pleats.

4. The handle of claim 1, wherein the first and second end portions have a lateral width that equal to or greater than combined lateral widths of the strap and the first and second lateral portions.

5. The handle of claim 1, wherein the strap, the first and second end portions, and the first and second lateral portions of the load bearing material are integrally formed as a unitary piece of load-bearing material.

6. The handle of claim 1, wherein the first and second end portions of the load bearing layer are drawn toward each other in the lengthwise direction to provide the excess length in the strap, and the first and second end portions are secured to the base layer in the drawn together state.

* * * * *